US009480111B2

(12) United States Patent
Zhong et al.

(10) Patent No.: US 9,480,111 B2
(45) Date of Patent: Oct. 25, 2016

(54) APPARATUS AND METHOD FOR DRIVING SEMICONDUCTOR LIGHT-EMITTING DEVICE ASSEMBLY

(71) Applicant: Delta Electronics (Shanghai) CO., LTD, Shanghai (CN)

(72) Inventors: Yuanyuan Zhong, Shanghai (CN); Weiqiang Zhang, Shanghai (CN); Lizhi Xu, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 0 days.

(21) Appl. No.: 14/537,649

(22) Filed: Nov. 10, 2014

(65) Prior Publication Data

US 2015/0145426 A1 May 28, 2015

(30) Foreign Application Priority Data

Nov. 22, 2013 (CN) ..... 2013 1 0597764

(51) Int. Cl.
*H05B 33/08* (2006.01)

(52) U.S. Cl.
CPC ..... *H05B 33/0815* (2013.01); *H05B 33/0827* (2013.01)

(58) Field of Classification Search
CPC ..... H05B 33/0815; H05B 33/0827
See application file for complete search history.

(56) References Cited

U.S. PATENT DOCUMENTS

2010/0123399 A1* 5/2010 Bollmann ..... H05B 33/089 315/122
2010/0156319 A1* 6/2010 Melanson ..... H05B 33/0839 315/297
2011/0169424 A1* 7/2011 Aboulnaga ..... H05B 33/0887 315/297
2012/0242240 A1* 9/2012 Rooijackers ..... 315/206
2013/0099670 A1* 4/2013 Jin ..... H05B 33/0815 315/120
2013/0099684 A1* 4/2013 Cheng ..... H05B 33/0818 315/186
2013/0271019 A1* 10/2013 Tsai ..... H05B 33/0827 315/192

FOREIGN PATENT DOCUMENTS

CN 102209413 B 11/2013
CN 203301814 U 11/2013
CN 103427395 A 12/2013
TW M461959 9/2013
TW 21343000 A 10/2013

OTHER PUBLICATIONS

Taiwan Office Action issued Jul. 17, 2015.
Office Action issued on Jul. 19, 2016 by the CN Office.

* cited by examiner

*Primary Examiner* — Tung X Le
*Assistant Examiner* — Raymond R Chai
(74) *Attorney, Agent, or Firm* — Yunling Ren; Eaton & Van Winkle

(57) ABSTRACT

The disclosure provides a driving apparatus and a method for driving a semiconductor light-emitting device assembly. The apparatus includes: a driving unit configured to drive the semiconductor light-emitting device assembly; and a cycle by cycle control unit. The cycle by cycle control unit may include: a sampling circuit configured to sample a current instantaneous value of the driving unit or the semiconductor light-emitting device assembly; and an adjusting circuit configured to adjust an output of the driving unit when the current instantaneous value sampled by the sampling circuit is larger than or equal to a preset reference value. The driving apparatus and method for driving the semiconductor light-emitting device assembly may effectively reduce an inrush current on the light-emitting devices and have a lower cost.

14 Claims, 12 Drawing Sheets

WITH CURRENT LIMITATION (a)

WITHOUT CURRENT LIMITATION (b)

APPARATUS AND METHOD FOR DRIVING SEMICONDUCTOR LIGHT-EMITTING DEVICE ASSEMBLY

CROSS REFERENCE TO RELATED APPLICATIONS

This application claims the priority to and the benefit of Chinese Patent Application No. 201310597764.9, filed on Nov. 22, 2013, which is incorporated herein by reference in its entirety.

TECHNICAL FIELD

The disclosure relates to a driving apparatus and a method for driving a semiconductor light-emitting device assembly.

BACKGROUND

With in-depth development of semiconductor technology, conventional light sources are gradually replaced with semiconductor light-emitting devices such as LEDs or semiconductor lasers due to their advantages such as high efficiency, long life, difficult to be dilapidated, and high reliability, and the semiconductor light-emitting devices have been used widely.

Generally, the semiconductor light-emitting device is driven in a constant-current manner. Taking the LED as an example, FIG. 1 is a schematic diagram illustrating that the LED is driven in a common constant-current manner. In FIG. 1, a LED driver 1 is used to drive a LED module 2, and a constant-current control unit 3 samples a current average value of the LED module 2 from a sampling point A, then feeds back the sampled current average value to the LED driver 1, and then the LED driver 1 adjusts the LED module 2 based on the current average value. The LED module 2 (i.e., a load) in FIG. 1 may be a single LED light, a LED light string composed of a plurality of LEDs connected in series, or LED lights composed of a plurality of LED strings connected in series or in parallel. Moreover, the LED module 2 may include other circuits such as a current balancing circuit, a filter capacitor or a protection circuit.

The existing LED driving circuit generally relates to applications of a plurality of strings of LED lights. For such LED circuit with multiple strings of LEDs, if a certain string or a plurality of strings of LEDs fail, it is generally required that the remained strings of LEDs can continue operating. Therefore, a protection circuit is generally connected in parallel with the LED string to short out the failed LED string, so as to ensure the remained strings to operate normally. Such protection circuit is, for example, shown in portion (b) of FIG. 2. In the portion (b) of FIG. 2, the protection circuit 21 includes a Zener diode D11, a resistor R11 and a thyristor Q11. The Zener diode D11 is connected in series with the resistor R11; an anode of the Zener diode D11 is connected with a second end of the resistor R11; a gate of the thyristor Q11 is connected to a connection point between the anode of the Zener diode D11 and the second end of the resistor R11; an anode of the thyristor Q11 is connected to a cathode of the Zener diode D11; and a cathode of the thyristor Q11 is connected to a first end of the resistor R11.

Additionally, portion (a) of FIG. 2 is a detailed circuit diagram showing that the LED module 2 having a plurality of strings of LED lights is driven by the constant-current control unit 3. In the portion (a) of FIG. 2, the LED driver 1 includes switching elements S1 and S2, a resonant circuit and a transformer Tr. The resonant circuit includes a resonant inductor Ls and a resonant capacitor Cs connected in series. One end of the resonant circuit is connected to a connection point between the switching elements S1 and S2, and the other end of the resonant circuit is connected to a primary side of the transformer Tr. In addition, the LED module 2 includes a current balancing circuit. The current balancing circuit includes current balancing capacitors C1-C5, rectifier diodes D1-D6 and six groups of LED loads LED1-LED6. Each group of LED load includes a filter capacitor Co1-Co6, a protection circuit 21 and a LED string. The LED string may include one or more LEDs. The switching elements S1 and S2 are connected in series to form a half-bridge switching circuit, so as to convert a DC input voltage into a DC square wave signal and then transfer the DC square wave signal to the resonant circuit and the transformer Tr. The output from a secondary side of the transformer Tr is an AC current source, so as to power the LED module 2 shown on the right side of the portion (a) of FIG. 2. The constant-current control unit 3 is connected between the LED driver 1 and the LED module 2, and may sample the current average value from any sampling point at which the LED current can be reflected. Such sampling point may be, for example, sampling point SA, SB, SC, SD, SE, SF or SG shown in the (a) portion of FIG. 2. The constant-current control unit 3 controls an output of the LED driver 1 according to the sampled current average values. That is, when the LED operates in the constant-current mode, a feedback may be realized by detecting an average value of secondary side currents of the transformer Tr.

However, when a circuit of any string of LEDs fails, the protection circuit 21 shorts out this string of LEDs, and the load of the circuit will change suddenly. Accordingly, a gain of the resonant circuit will change suddenly, and a current which is much larger than a current in a normal state, i.e., an inrush current, will be occurred at the secondary side of the transformer Tr. Since a speed of a feedback loop in the above constant-current mode is not fast enough to perform adjustments to the inrush current in time, a life of the LED is reduced by the inrush current.

According to a conventional manner for avoiding the inrush current, a positive temperature coefficient (PTC) element as shown in FIG. 3 is connected in series to the LED load. Such manner has a low cost, but the introduction of the PTC element may cause an increase of the line impedance so that the loss of line in the normal state increases.

Accordingly, it is very urgent to develop a circuit for suppressing current impact, reducing the current impact and having a low cost, so as to overcome at least in part the above deficiencies in the related art.

SUMMARY

With respect to the problems existing in the related art, an object of the disclosure is to provide a driving apparatus and a method for driving a semiconductor light-emitting device assembly which could effectively reduce a current impact on the light-emitting devices.

Another object of the disclosure is to provide an apparatus and a method for driving a semiconductor light-emitting device assembly having a lower cost.

To achieve the above objects, one aspect of the disclosure provides a driving apparatus for driving a semiconductor light-emitting device assembly, including: a driving unit configured to drive the semiconductor light-emitting device assembly; and a cycle by cycle control unit. The cycle by cycle control unit may include: a sampling circuit configured to sample a current instantaneous value of the driving unit or the semiconductor light-emitting device assembly; and an adjusting circuit configured to adjust an output of the driving unit when the current instantaneous value sampled by the sampling circuit is larger than or equal to a preset reference value.

Additionally, the semiconductor light-emitting device assembly may include more than one string of semiconductor light-emitting devices connected in parallel.

Additionally, each string of the semiconductor light-emitting device may include a filter capacitor, a protection circuit and a LED string. The filter capacitor and the protection circuit may be respectively connected in parallel to two ends of the LED string.

Additionally, the driving apparatus for driving the semiconductor light-emitting device assembly may further include a constant-current control unit which is configured to sample a current average value of the semiconductor light-emitting device assembly and control the driving unit to drive the semiconductor light-emitting device assembly according to the current average value.

Additionally, a sampling point from which the sampling circuit samples the current instantaneous value may be the same as a sampling point from which the constant-current control unit samples the current average value.

Additionally, a sampling point from which the sampling circuit samples the current instantaneous value may be different from a sampling point from which the constant-current control unit samples the current average value.

Additionally, the driving unit may include a first switch, a second switch, a resonant circuit and a transformer. The first switch may be connected with the second switch in series, one end of the resonant circuit may be connected to a connection point between the first switch and the second switch, the other end of the resonant circuit may be connected to one end of a primary side of the transformer, and the other end of the primary side of the transformer may be connected to one end of the second switch which is not connected to the first switch.

Additionally, the sampling circuit may include a first resistor and a second resistor connected in series. One end of the first resistor may be connected to a sampling point for sampling currents, the other end of the first resistor may be connected to one end of the second resistor, and the other end of the second resistor may be grounded.

Additionally, the adjusting circuit may include a third resistor and a transistor. An emitter of the transistor may be grounded, a base of the transistor may be connected to a connection point between the first resistor and the second resistor, a collector of the transistor may be connected to one end of the third resistor, and the other end of the third resistor may be connected to the driving unit.

Additionally, the adjusting circuit may include a digital signal processing unit of which an input terminal may be connected to a connection point between the first resistor and the second resistor and an output terminal may be connected to the driving unit.

Additionally, the adjusting circuit may be configured to adjust the output of the driving unit when the current instantaneous value sampled by the sampling circuit is larger than or equal to the preset reference value, so as to limit a current peak of the semiconductor light-emitting device assembly.

Additionally, the adjusting circuit may be configured to limit the current peak of the semiconductor light-emitting device assembly by adjusting an operating frequency of the driving unit.

Additionally, the adjusting circuit is configured to limit the current peak of the semiconductor light-emitting device assembly by adjusting a duty cycle of the driving unit.

Additionally, the driving unit may be a forward circuit, a flyback circuit, a half-bridge switching circuit or a full bridge switching circuit.

Another aspect of the disclosure provides a driving method for driving a semiconductor light-emitting device assembly by using the above driving apparatus, including: the sampling circuit samples a current instantaneous value of the driving unit or the semiconductor light-emitting device assembly; the current instantaneous value is compared with the preset reference value to adjust the output of the driving unit according to the compared result; and the semiconductor light-emitting device assembly is driven according to the output of the driving unit.

Additionally, the method further includes: the cycle by cycle control unit adjusts the output of the driving unit when the current instantaneous value is larger than or equal to the preset reference value.

The foregoing summary is not intended to summarize each potential embodiment or every aspect of the present disclosure.

Specific embodiments in this disclosure have been shown by way of example in the foregoing drawings and are hereinafter described in detail. The figures and written description are not intended to limit the scope of the inventive concepts in any manner. Rather, they are provided to illustrate the inventive concepts to a person skilled in the art by reference to particular embodiments.

DETAILED DESCRIPTION

The embodiments of the present disclosure will be described below clearly and completely. It should be noted that the description intends to exemplify the embodiments rather than limit the protection scope of the disclosure.

The driving apparatus and method are used for driving a semiconductor light-emitting device assembly which is, for example, a group consisted of a plurality of semiconductor light-emitting devices (such as LEDs or semiconductor lasers) connected in parallel.

Figure 11:
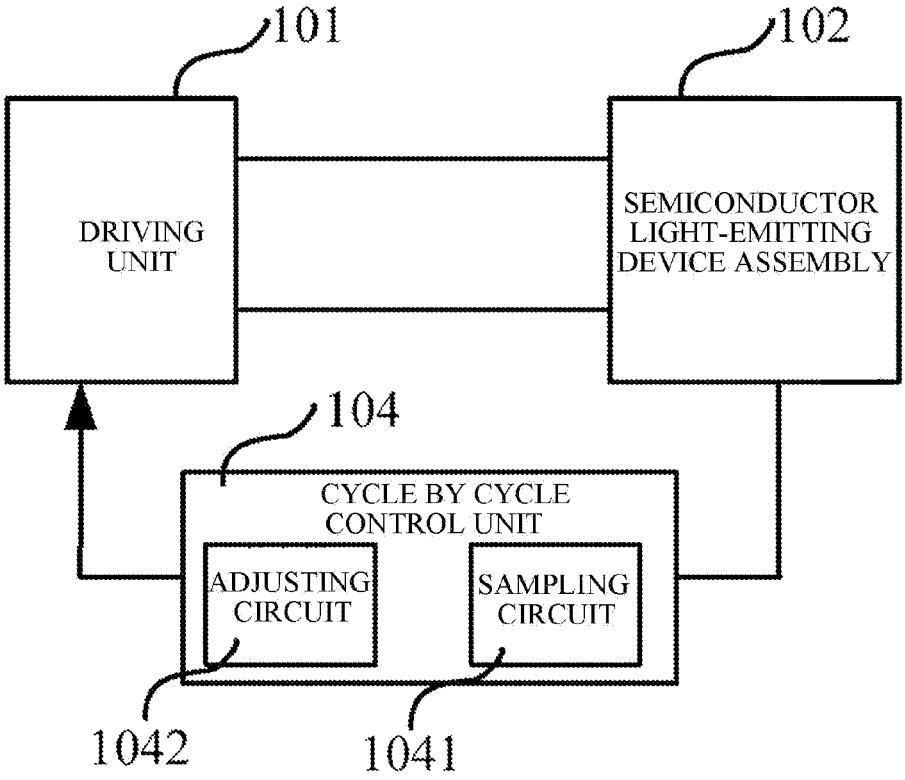
FIG. 11 is an illustrative diagram showing the driving apparatus for driving a semiconductor light-emitting device assembly according to an embodiment of the disclosure.

Firstly, a driving apparatus for driving a semiconductor light-emitting device assembly according to the disclosure is described with reference to FIG. 11. The driving apparatus includes a driving unit 101 configured to drive the semiconductor light-emitting device assembly 102; and a cycle by cycle control unit 104. The cycle by cycle control unit 104 includes a sampling circuit 1041 configured to sample a current instantaneous value of the driving unit 101 or the semiconductor light-emitting device assembly 102; and an adjusting circuit 1042 configured to adjust an output of the driving unit 101 when the current instantaneous value sampled by the sampling circuit 1041 is larger than or equal to a preset reference value. The semiconductor light-emitting device assembly 102 may include more than one string of semiconductor light-emitting devices connected in parallel. In addition, each string of semiconductor light-emitting devices may include a filter capacitor, a protection circuit and a LED string. The filter capacitor and the protection circuit are connected in parallel to two ends of the LED string, respectively.

Figure 6:
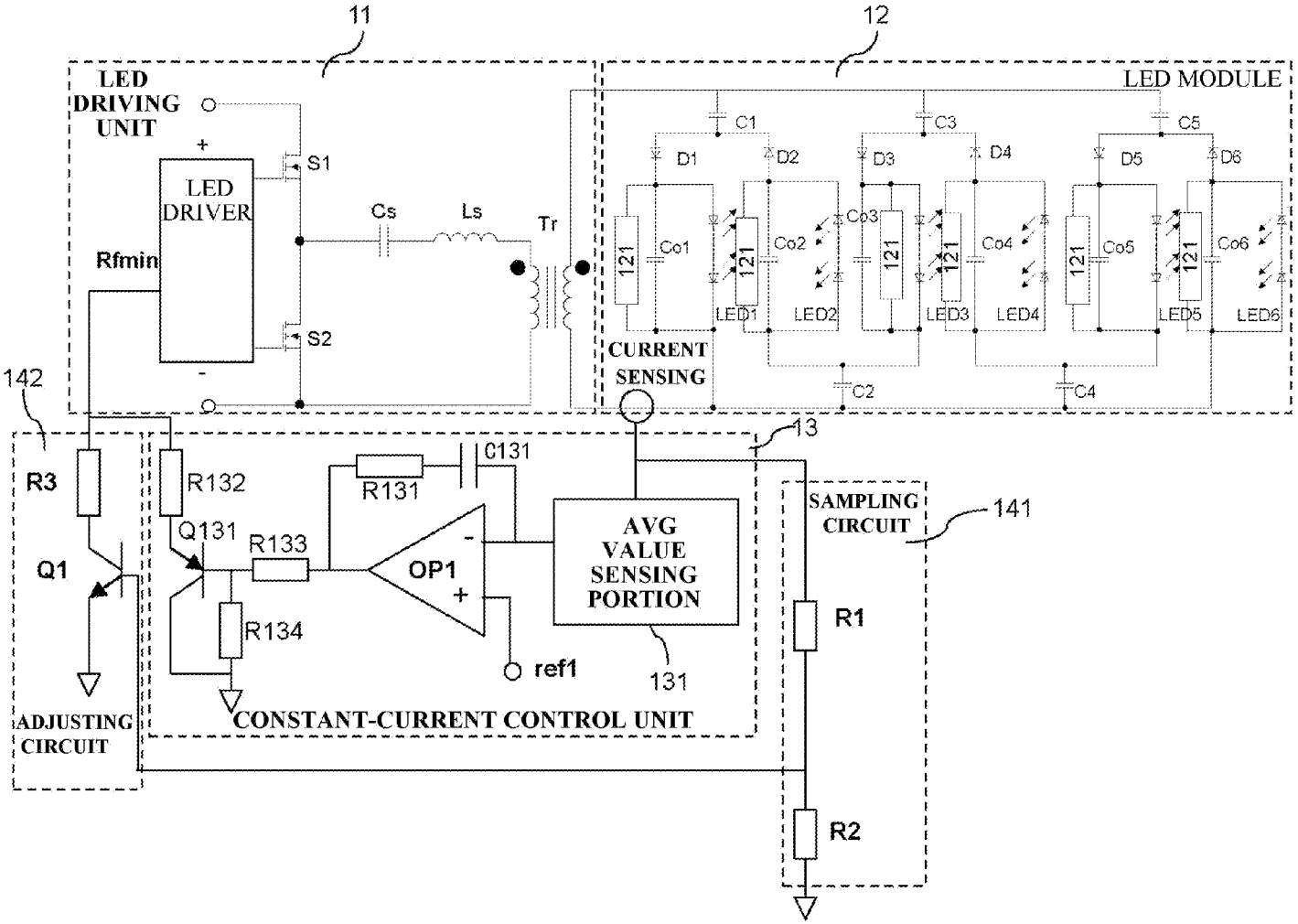
FIG. 6 is an illustrative detailed circuit diagram showing that the LED module is driven in a frequency adjustment manner according to a first embodiment of the disclosure.

The driving apparatus according to the disclosure may also include a constant-current control unit (such as a constant-current control unit 13 shown in FIG. 6). The constant-current control unit is configured to sample a current average value of the semiconductor light-emitting device assembly 102 and drive the semiconductor light-emitting device assembly 102 based on the sampled current average value.

In an example, a sampling point from which the sampling circuit 1041 samples the current instantaneous value may be the same as that from which the constant-current control unit 13 samples the current average value. In another example, the sampling point from which the sampling circuit 1041 samples the current instantaneous value may be different from that from which the constant-current control unit 13 samples the current average value.

Figure 5:
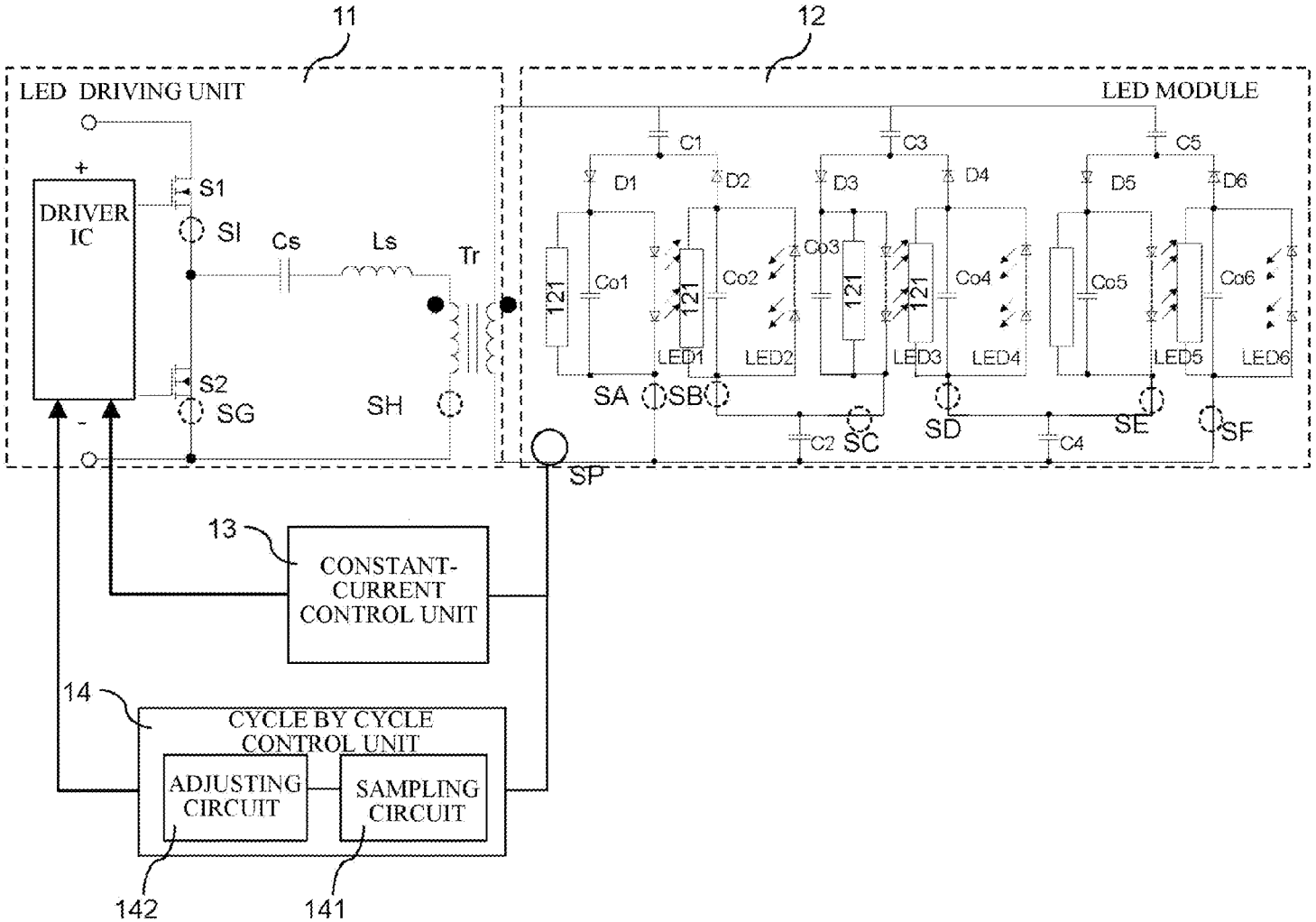
FIG. 5 is an illustrative circuit diagram showing that the LED module is driven by a driving apparatus according to an embodiment of the disclosure.

The driving unit 101 may have a structure similar to that of the LED driving unit shown in FIG. 5. For example, the driving unit 101 may include a first switch, a second switch, a resonant circuit and a transformer. The first switch is connected in series with the second switch. One end of the resonant circuit is connected to a connection point between the first switch and the second switch, and the other end of the resonant circuit is connected to one end of a primary side of the transformer. The other end of the primary side of the transformer is connected to one end of the second switch which is not connected to the first switch.

The sampling circuit 1041 may include a first resistor and a second resistor connected in series with each other. One end of the first resistor is connected to a sampling point for sampling currents, and the other end of the first resistor is connected to one end of the second resistor. The other end of the second resistor is grounded.

The adjusting circuit 1042 may include a third resistor and a transistor. An emitter of the transistor is grounded, a base of the transistor is connected to a connection point between the first resistor and the second resistor, a collector of the transistor is connected to one end of the third resistor, and the other end of the third resistor is connected to the driving unit 101.

When the current instantaneous value sampled by the sampling circuit 1041 is larger than or equal to the preset reference value, the adjusting circuit 1042 adjusts the output of the driving unit 101 to limit a current peak of the semiconductor light-emitting device assembly 102.

The adjusting circuit 1042 may limit the current peak of the semiconductor light-emitting device assembly 102 by adjusting a frequency of the driving unit 101. Or, the adjusting circuit 1042 may limit the current peak of the semiconductor light-emitting device assembly 102 by adjusting a duty cycle of the driving unit 101.

The driving unit 101 may be a forward circuit, a flyback circuit, a half-bridge switching circuit or a full-bridge switching circuit.

Figure 12:
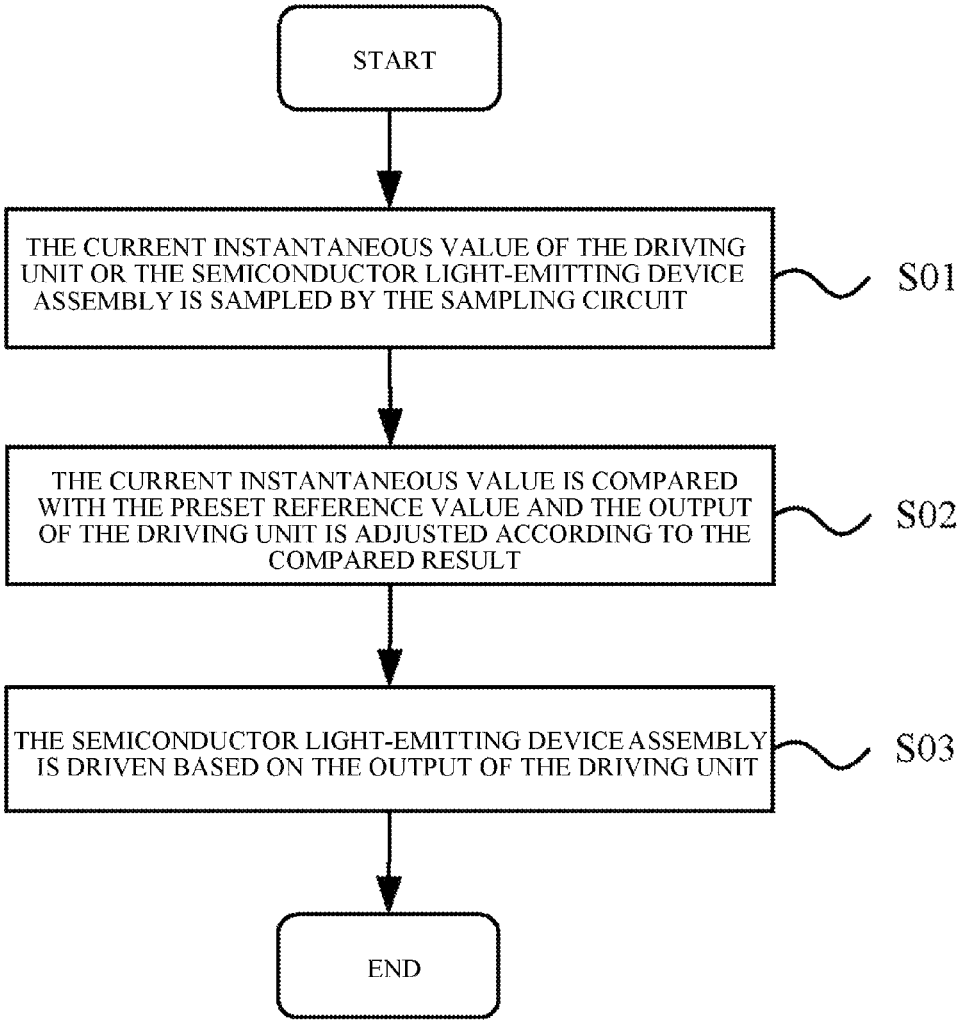
FIG. 12 is an illustrative flowchart showing a method for driving a semiconductor light-emitting device assembly according to an embodiment of the disclosure.

In addition, embodiments of the disclosure also provide a method for driving a semiconductor light-emitting device assembly using the above driving apparatus. As shown in FIG. 12, in a step S01, a current instantaneous value of the driving unit 101 or the semiconductor light-emitting device assembly 102 is sampled by the sampling circuit 1041; in a step S02, the current instantaneous value is compared with a preset reference value and an output of the driving unit 101 is adjusted according to the compared result; and in a step S03, the semiconductor light-emitting device assembly 102 is driven based on the output of the driving unit.

Figure 13:
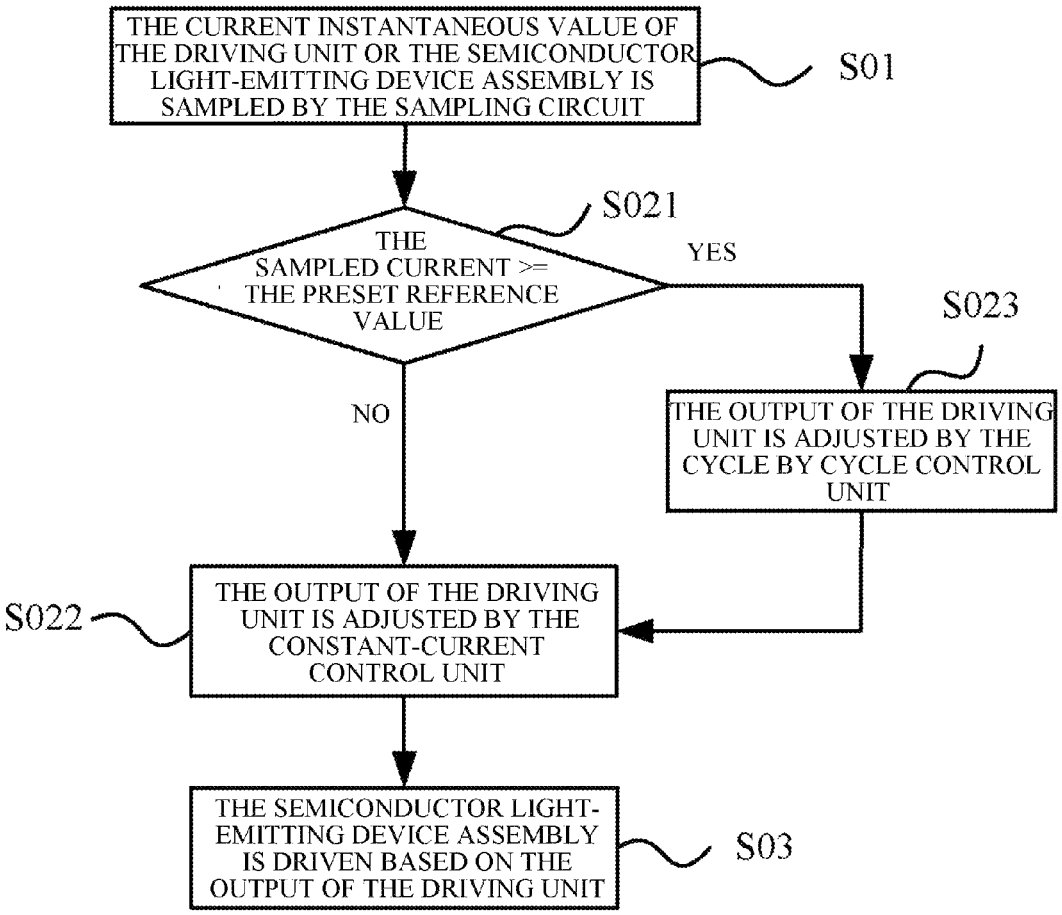
FIG. 13 is an illustrative flowchart of step S02 shown in FIG. 12.

The detailed flow of the step S02 will be described with reference to FIG. 13. After the current instantaneous value of the driving unit 101 or the semiconductor light-emitting device assembly 102 is sampled by the sampling circuit 1041 in the step S01, the process proceeds to a sub-step S021 of the step S02 to determine whether the sampled current instantaneous value is larger than or equal to the preset reference value. If it is determined in the sub-step S021 that the sampled current instantaneous value is less than the preset reference value, the process proceeds to a sub-step S022 of the step S02 to adjust the output of the driving unit using the constant-current control unit, so as to drive the semiconductor light-emitting device assembly 102; and if it is determined in the sub-step S021 that the sampled current instantaneous value is larger than or equal to the preset reference value, the process proceeds to a sub-step S023 of the step S02 to adjust the output of the driving unit 101 using the cycle by cycle control unit 104, such that the semiconductor light-emitting device assembly 102 is driven based on the output of the driving unit 101 adjusted by the constant-current control unit and the cycle by cycle control unit 104, and thus the current peak of the semiconductor light-emitting device assembly 102 may be limited.

The driving apparatus and method will be described in detail by taking a LED as an example. However, the person skilled in the art shall appreciate that the driving apparatus and method according to the disclosure are also suitable for any other semiconductor light-emitting devices.

Firstly, the principle that a LED module 12 is driven by the driving apparatus according to the disclosure will be described with reference to FIG. 4.

Figure 4:
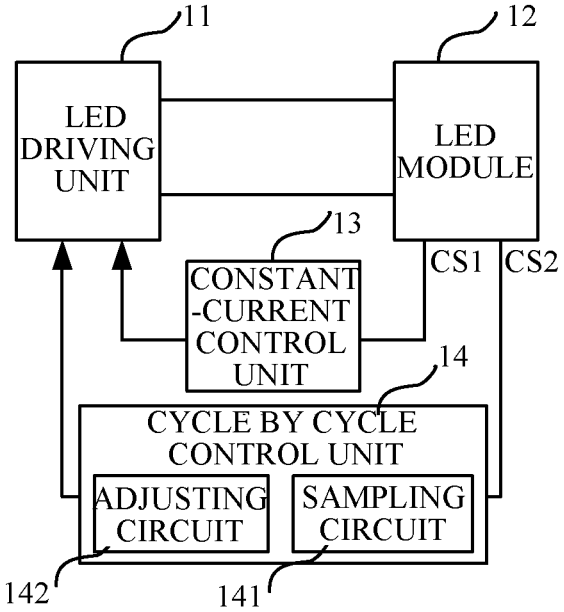
FIG. 4 is an illustrative diagram showing a LED driver for driving a LED module according to an embodiment of the disclosure.

As shown in FIG. 4, the driving apparatus of the disclosure includes a LED driving unit 11 and a constant-current control unit 13. The LED driving unit 11 is connected with the LED module 12 to drive the LED module 12. One end of the constant-current control unit 13 is connected to the LED module, and the other end of the constant-current control unit 13 is connected to the LED driving unit 11, so as to sample a current average value of the LED module 12 and adjust the LED module 12 through the LED driving unit 11 based on the sampled current average value in a feedback manner. Specifically, the constant-current control unit 13 samples the current average value of the LED module 12 so as to control the output of the LED driving unit 11.

In addition, as shown in FIG. 4, the driving apparatus according to the disclosure may also include a cycle by cycle control unit 14 which is connected between the LED module 12 and the LED driving unit 11 and includes a sampling circuit 141 and an adjusting circuit 142. The cycle by cycle control unit 14 samples a current instantaneous value of the LED driving unit 11 or the LED module 12 using the sampling circuit 141; and the adjusting circuit 142 adjusts the output of the LED driving unit 11 when the sampled current instantaneous value is larger than or equal to a preset reference value, so as to quickly adjust a current value output from the LED driving unit 11 and a current value of the LED module 12.

In FIG. 4, the current average value sampled by the constant-current control unit 13 is CS1 and the current instantaneous value sampled by the cycle by cycle control unit 14 is CS2. Sampling point from which the cycle by cycle control unit 14 samples the current instantaneous value may be the same as that from which the constant-current control unit 13 samples the current average value. Alternatively, the sampling point from which the cycle by cycle control unit 14 samples the current instantaneous value may be different from that from which the constant-current control unit 13 samples the current average value.

A detailed circuit showing that the LED module 12 is driven by the driving apparatus according to the disclosure will be described with reference to FIG. 5.

As shown in FIG. 5, the LED driving unit 11 includes switching elements S1 and S2, a resonant inductor Ls, a resonant capacitor Cs and a transformer Tr. The resonant inductor Ls and the resonant capacitor Cs are connected in series with each other to form a resonant circuit. One end of the resonant circuit is connected to a connection point between a second end of the switching element S1 and a first end of the switching element S2, the other end of the resonant circuit is connected to one end of a primary side of the transformer Tr. The other end of the primary side of the transformer Tr is connected to a second end of the switching element S2. A power supply (which may be a DC power supply or an AC power supply) is connected between a first end of the switching element S1 and the second end of the switching element S2 to provide a voltage signal. A secondary side of the transformer Tr is connected to the LED module 12 to power the LED module 12.

Figure 1:
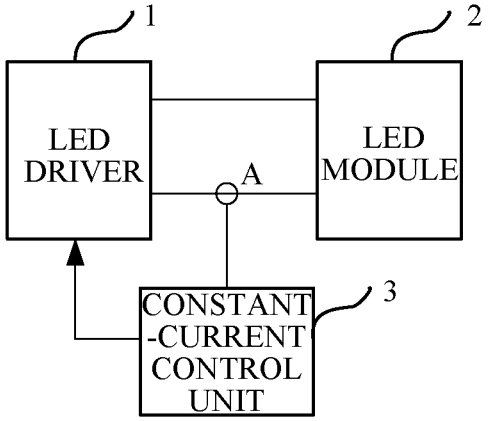
Prior Art Fig.1
FIG. 1 is an illustrative diagram showing that a LED module is driven by a LED driver in a constant-current control manner according to the conventional art.
Figure 2:
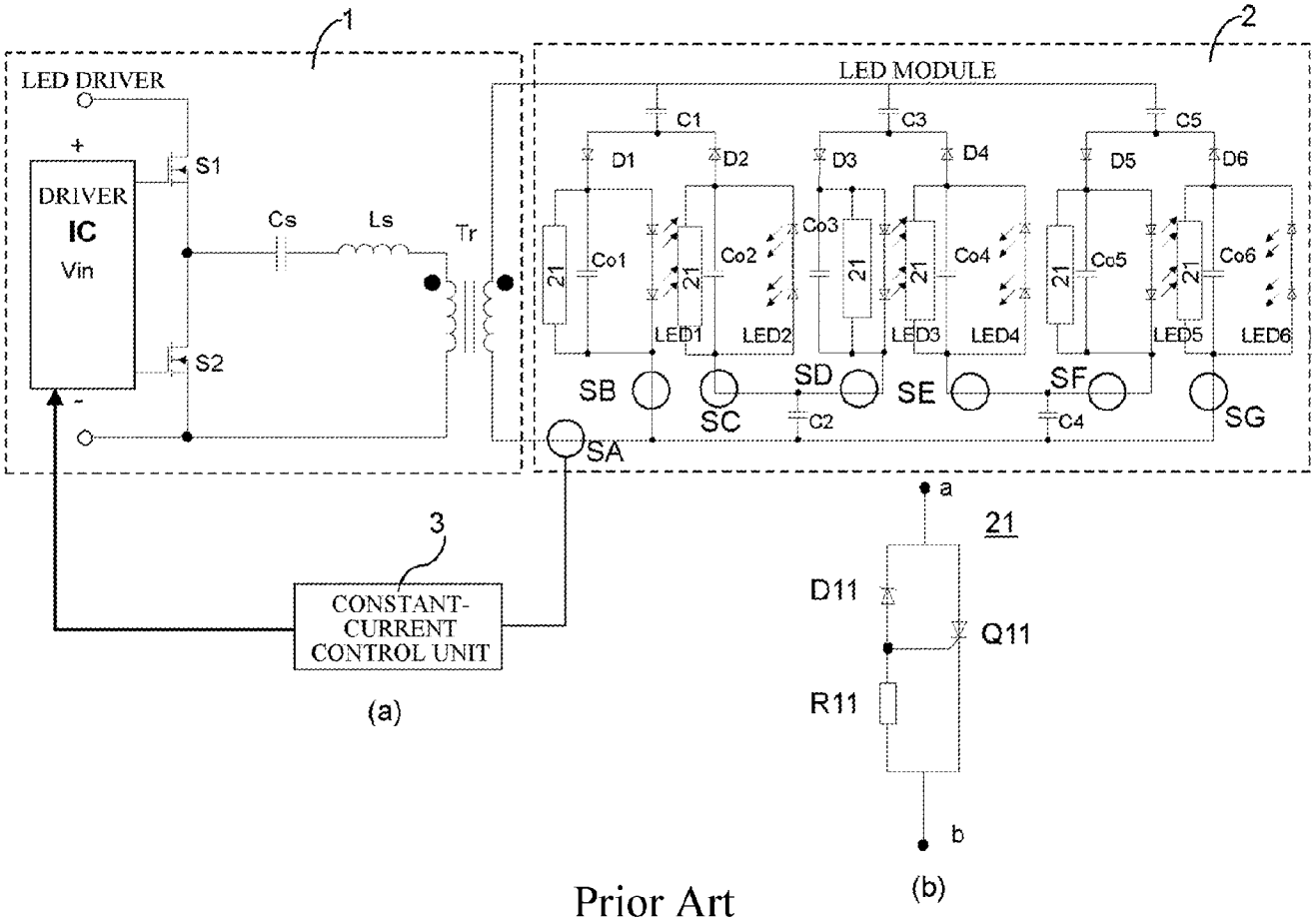
Prior Art Fig.2
FIG. 2 is an illustrative detailed circuit diagram showing that a LED module including a plurality of strings of LED lights is driven by a constant-current control unit.
Figure 3:
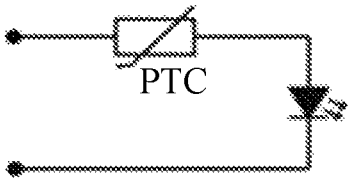
Prior Art Fig.3
FIG. 3 shows an illustrative circuit diagram that a positive temperature coefficient (PTC) element is connected in series with a LED.

In addition, the LED module 12 in FIG. 5 includes current balancing capacitors C1-C5, rectifier diodes D1-D6 and six groups of LED loads LED1-LED6. It should be noted that although six groups of LED loads are shown herein, the person skilled in the art may use more or less groups of LED loads based on actual requirements, that is, the LED module 12 may include N LED strings, wherein N>=2 and N is an integer. Each group of LED load includes a filter capacitor Co1-Co6, a protection circuit 121 and a LED string which are connected in parallel with each other. The LED string may include at least one LED. The protection circuit 121 is used to short out a LED string when this LED string fails, for avoiding affecting the remained LED strings. The detailed structure of the protection circuit 121 may be the same as that of the protection circuit 21 shown in the portion (b) of FIG. 2. A first end of the load LED1 is connected to a cathode of the rectifier diode D1. An anode of the rectifier diode D1 is connected to a first output terminal of the driving unit 11 via the capacitor C1. A second end of the load LED1 is connected to a second output terminal of the driving unit 11. A first end of the load LED2 is connected to an anode of the rectifier diode D2. The cathode of the rectifier diode D2 is connected to the first output terminal of the driving unit 11 via the capacitor C1. A second end of the load LED2 is connected to the second output terminal of the driving unit 11 via the capacitor C2. A first end of the load LED3 is connected to a cathode of the rectifier diode D3. The anode of the rectifier diode D3 is connected to the first output terminal of the driving unit 11 via the capacitor C3. A second end of the load LED3 is connected to the second output terminal of the driving unit 11 via the capacitor C2. A first end of the load LED4 is connected to an anode of the rectifier diode D4. A cathode of the rectifier diode D4 is connected to the first output terminal of the driving unit 11 via the capacitor C3. A second end of the load LED4 is connected to the second output terminal of the driving unit 11 via the capacitor C4. A first end of the load LED5 is connected to a cathode of the rectifier diode D5. An anode of the rectifier diode D5 is connected to the first output terminal of the driving unit 11 via the capacitor C5. A second end of the load LED5 is connected to the second output terminal of the driving unit 11 via the capacitor C4. A first end of the load LED6 is connected to an anode of the rectifier diode D6. A cathode of the rectifier diode D6 is connected to the first output terminal of the driving unit 11 via the capacitor C5. A second end of the load LED6 is connected to the second output terminal of the driving unit 11. The load LED1 and the rectifier diode D1 have the same polarities. The load LED2 and the rectifier diode D2 have the same polarities. The load LED3 and the rectifier diode D3 have the same polarities. The load LED4 and the rectifier diode D4 have the same polarities. The load LED5 and the rectifier diode D5 have the same polarities. The load LED6 and the rectifier diode D6 have the same polarities. It should be noted that "have the same polarities" means that both of the anode of the rectifier diode and the anode of the LED light in the load LED are at the same side, that is, the anode of the rectifier diode is connected to the cathode of the LED light in the load LED.

In addition, the switching elements S1 and S2 are connected in series to form a half-bridge switching circuit and receive a DC voltage Vcc. The switching elements S1 and S2 may convert a DC input voltage into a DC square wave signal and transmit the DC square wave signal to the resonant capacitor Cs, the resonant inductor Ls and the transformer Tr. After being voltage transformation by the resonant capacitor Cs, the resonant inductor Ls and the transformer Tr, the secondary side of the transformer Tr outputs an AC power so as to power the LED module 12 shown at right side of FIG. 5.

Hereinafter, a process that the LED module 12 is driven by the driving apparatus according to the disclosure will be described. When the LED module 12 operates in the constant-current mode, the constant-current control unit 13 detects a current average value of the secondary side of the transformer Tr, performs a process according to the current average value and outputs a control signal to the LED driving unit 11 to drive the LED module 12. However, when a circuit of any LED string in the LED module 12 fails, the protection circuit 121 shorts out the failed LED string, and thus the load changes suddenly. Accordingly, a gain of the resonant circuit changes suddenly, and a current which is much larger than a current in a normal state, i.e., an inrush current (i.e., the current instantaneous value sampled by the cycle by cycle control unit 14) is occurred at the secondary side of the transformer Tr. When the inrush current is larger than or equal to the preset reference value, the cycle by cycle control unit 14 may adjust the output of the LED driving unit 11 to limit a current peak of the secondary side of the transformer Tr. Since the current value of the secondary side of the transformer Tr is a sum of currents of all the LED strings, the current peak of the LED strings also may be limited effectively. In each resonant period, as long as the current instantaneous value is detected to be larger than or equal to the preset reference value, the cycle by cycle control unit 14 adjusts the output of the LED driving unit 11; and if it is detected that the current instantaneous value is less than the preset reference value, the cycle by cycle control unit 14 does not adjust the output of the LED driving unit 11. Therefore, the loop of the cycle by cycle control unit 14 may have the function of limiting the current cycle by cycle until the output current of the circuit is adjusted to a rating value by the constant-current control unit 13.

It should be noted that although the LED driving unit 11 is realized by the half-bridge switching circuit as described herein, the LED driving unit 11 may also be realized by a forward circuit, a flyback circuit, a full bridge switching circuit or any other circuits.

In addition, as shown in FIG. 5, the sampling point for the constant-current control unit 13 may be a point SP, or any other sampling point at which the LED current could be reflected, such as point SA, SB, SC, SD, SE, or SF. Alternatively, the currents flowing through LED1, LED2, LED3, LED4, LED5, LED6 may be sampled.

The sampling point for the cycle by cycle control unit 14 may be a sampling point SP, or any other sampling point at which the LED current could be reflected, such as SH, SG, or SI. Alternatively, the currents may be sampled from sampling points SA, SB, SC, SD, SE, SF and then the sampled results are summed to obtain the current instantaneous value required by the cycle by cycle control unit 14. The sampling point for the cycle by cycle circuit 14 may be the same as that for the constant-current control unit 13. Alternatively, the sampling point for the cycle by cycle circuit 14 may be different from that for the constant-current control unit 13.

In the implementation, the sampling point includes a resistor, a current transformer or other elements which could reflect the current value, so as to sample currents at corresponding positions. The corresponding position, from which the constant-current control unit 13 samples current, may be the sampling point SP, or any other sampling points at which the LED current could be reflected, such as SA, SB, SC, SD, SE, SF. Alternatively, the currents flowing through LED1, LED2, LED3, LED4, LED5, LED6 may be sampled. The corresponding position, from which the cycle by cycle control unit 14 samples currents, may be the sampling point SP, or any other sampling points at which the LED peak current could be reflected, such as SH, SG, SI; or, the currents may be sampled from the sampling points SA, SB, SC, SD, SE, SF and then the sampled results are summed.

First Embodiment

Hereinafter, a more detailed circuit that the LED module 12 is driven by the driving apparatus according to the disclosure will be described with reference to FIG. 6, in which respective circuit configurations of the constant-current control unit 13 and the cycle by cycle control unit 14 are shown in detail.

As shown in FIG. 6, a driving apparatus according to the first embodiment includes a LED driving unit 11 which is connected to a LED module 12 to drive the LED module 12. Since the configurations of the LED driving unit 11 and the LED module 12 herein are the same as those shown in FIG. 5, the detailed description will be omitted.

Further referring to FIG. 6, the driving apparatus according to the first embodiment may also include a constant-current control unit 13. The constant-current control unit 13 includes a current sensing portion (i.e., an AVG value sensing portion) 131, an operational amplifier OP1, a transistor Q131, a capacitor C131 and resistors R131-R134. One end of the current sensing portion 131 is connected to a sampling point of the LED module 12, and the other end of the current sensing portion 131 is connected to an inverting input terminal of the operational amplifier OP1. A non-inverting input terminal of the operational amplifier OP1 receives a preset reference value ref1. An output terminal of the operational amplifier OP1 is connected to a base of the transistor Q131 via the resistor R133. A collector of the transistor Q131 is grounded and a source of the transistor Q131 is connected to a terminal Rfmin of a driver IC of the LED driving unit 11 via the resistor R132. The resistor R131 and the capacitor C131 are connected in series with each other and connected between the inverting input terminal and the output terminal of the operational amplifier.

The operation principle of the constant-current control unit 13 will be described with reference to FIG. 6. Firstly, the current sensing portion 131 detects a current average value of the LED module 12 and outputs the current average value to the operational amplifier OP1. The operational amplifier OP1 compares the input current average value with the preset reference value ref1; if the current average value is less than the preset reference value ref1, the output of the operational amplifier OP1 is positive, so that the transistor Q131 is in a cut-off state, i.e., the transistor is not conducted; and if the current average value is larger than or equal to the preset reference value ref1, the output of the operational amplifier OP1 is negative, so that the transistor Q131 is in an amplifying state or a saturation state, i.e., the transistor Q131 is conducted. In this way, an output impedance between the output terminal of the constant-current control unit and the LED driving unit 11 is adjustable, so that the output of the LED driving unit 11 is controllable.

With reference to FIG. 6, the driving apparatus according to the first embodiment of the disclosure may also include a cycle by cycle control unit 14. The cycle by cycle control unit 14 includes a sampling circuit 141 and an adjusting circuit 142. The sampling circuit 141 includes resistors R1 and R2 which are connected in series with each other. One end of the resistor R1 is connected to a sampling point for sampling current. The sampling point may be a point SP, SH, SG or SI; or currents at sampling points SA, SB, SC, SD, SE, SF may be sampled respectively and the summation of all the sampled currents may be used as the sampling current of the cycle by cycle control unit 14. This sampling point may be the same as a sensing point at which the above current sensing portion 131 detects the current average value of the LED module 12, or they may be different. The other end of the resistor R1 is connected to one end of the resistor R2, and the other end of the resistor R2 is grounded.

The adjusting circuit 142 includes a resistor R3 and a transistor Q1. An emitter of the transistor Q1 is grounded, a base is connected to a connection point between the resistors R1 and R2, and a collector is connected to one end of the resistor R3. The other end of the resistor R3 is connected to the input terminal Rfmin of the driver IC of the LED driving unit 11.

The operation principle of the cycle by cycle control unit 14 will be described with reference to FIG. 6. An adjusting signal which is received from the adjusting circuit 142 by the terminal Rfmin of the driver IC of a half-bridge circuit consisted of switching elements S1 and S2 determines an operating frequency of the half-bridge circuit. Therefore, the adjusting circuit 142 of the cycle by cycle control unit 14 outputs the adjusting signal to change an output frequency of the driver IC, so as to control the driving for the LED module 12 to limit a current peak of the LED module 12. When the load changes suddenly, for example, one or more LEDs in the LED module 12 fail, a current of a secondary side of a transformer Tr changes suddenly, so that the sampled current instantaneous value signal also changes suddenly. When a signal, which is voltage divided by the resistors R1 and R2 in the sampling circuit, is larger than a conducting threshold value of the transistor Q1, the transistor Q1 is conducted, the resistor R3 is connected to the output terminal Rfmin of the driver IC, so that the resistance value connected to the output terminal Rfmin decreases, and thus the output frequency of the driver IC increases quickly. According to the characteristic of the LLC circuit, when the frequency increases, the current of the secondary side of the transformer Tr decreases, so that the inrush current on the LEDs in the LED module 12 may be suppressed effectively.

Figure 7:
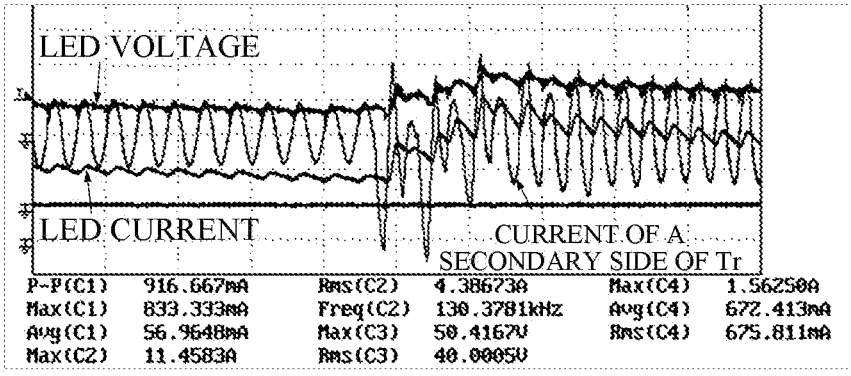
FIG. 7 is an illustrative comparison between an effect diagram showing that a semiconductor light-emitting device assembly is driven by the driving apparatus according to the disclosure and an effect diagram showing that the semiconductor light-emitting device assembly is not driven by the driving apparatus according to the disclosure.
Figure 7:
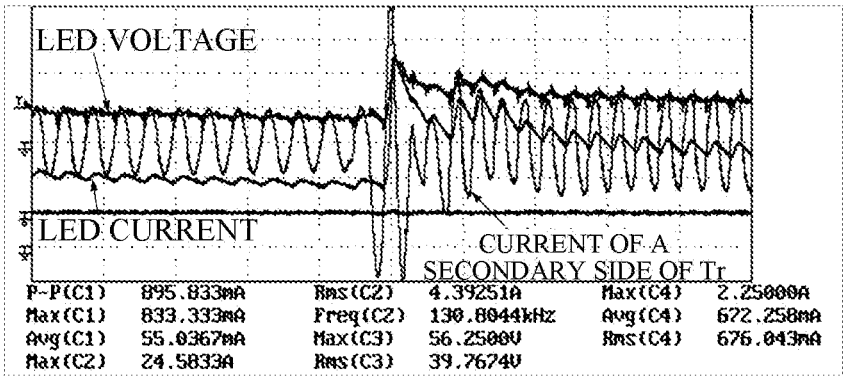

FIG. 7 is an illustrative comparison between an effect diagram showing that the semiconductor light-emitting device assembly is driven by the driving apparatus according to the disclosure and an effect diagram showing that the semiconductor light-emitting device assembly is not driven by the driving apparatus according to the disclosure. The portion (a) of FIG. 7 shows the test results that the semiconductor light-emitting device assembly is driven by the driving apparatus according to the disclosure, and the portion (b) shows the test results that the semiconductor light-emitting device assembly is not driven by the driving apparatus according to the disclosure. It can be seen from FIG. 7 that the current peak of the secondary side of the transformer Tr (see the waveform of the current of the secondary side of the transformer Tr in FIG. 7) and the current peak on the LED (see the waveform of the LED current in FIG. 7) may be suppressed effectively.

Second Embodiment

Different from the first embodiment in which the output of the LED driving unit 11 is controlled by adjusting frequency, in the second embodiment, the output of the LED driving unit 111 is controlled by adjusting a duty cycle.

Figure 9:
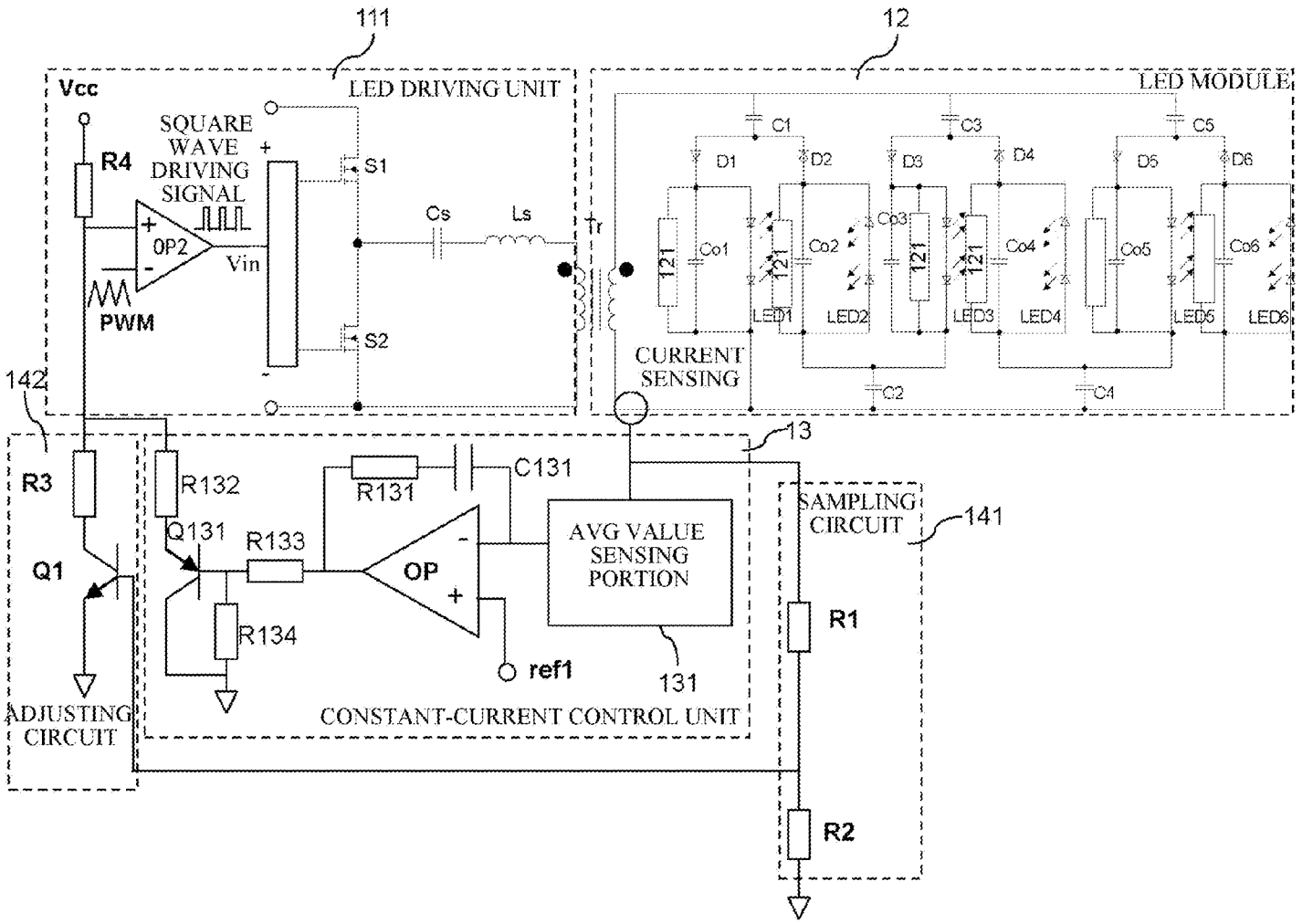
FIG. 9 is an illustrative detailed circuit diagram showing that the LED module is driven in the duty cycle adjustment manner according to the second embodiment of the disclosure.

As shown in FIG. 9, a driving apparatus according to the second embodiment of the disclosure includes a driving unit 111, a constant-current control unit 13 and a cycle by cycle control unit 14. The driving unit 111 is connected to a LED module 12 to drive the LED module 12. The constant-current control unit 13 and the cycle by cycle control unit 14 are connected between the LED driving unit 111 and the LED module 12 to control the LED module 12 in a feedback manner. Configurations of the LED module 12, the constant-current control unit 13 and the cycle by cycle control unit 14 are the same as those shown in FIG. 6, therefore the detailed description will be omitted.

With reference to FIG. 9, in addition to the switching elements S1 and S2 connected in series, the resonant capacitor Cs, the resonant inductor Ls, the transformer Tr and the driver IC, the LED driving unit 111 further includes an operational amplifier OP2. A non-inverting input terminal of the operational amplifier OP2 is connected to a resistor R3 of an adjusting circuit 142 and is connected to a DC voltage Vcc via a resistor R4. An inverting input terminal of the operational amplifier OP2 receives a PWM (Pulse Width Modulation) signal. An output terminal of the operational amplifier OP2 is connected to an input terminal Vin of the driver IC. The operation amplifier OP2 compares the received adjusting signal output from the adjusting circuit 142 with the PWM signal, and outputs the modulated square wave driving signal to the driver IC. A duty cycle of a driving signal output from the driver IC is determined by the adjusting signal output from the adjusting circuit 142. Therefore, the adjusting circuit 142 of the cycle by cycle control unit 14 outputs the adjusting signal to change the duty cycle of the driving signal output from the driver IC, so as to control the driving for the LED module 12 to limit a current peak of the LED module 12. When a load changes suddenly, for example, one or more LEDs in the LED module 12 fail, a current of a secondary side of a transformer Tr changes suddenly, so that the sampled current instantaneous value signal also changes suddenly. When a signal, which is voltage divided by the resistors R1 and R2 in the sampling circuit, is larger than a conducting threshold value of a transistor Q1, the transistor Q1 is conducted, the resistor R3 is connected to the non-inverting input terminal of the operational amplifier OP2 in the driving unit 111, so that the duty cycle of the driving signal output from the driver IC decreases, and thus the current of the secondary side of the transformer Tr decreases, so that an inrush current on the LEDs in the LED module 12 may be suppressed effectively.

Figure 8:
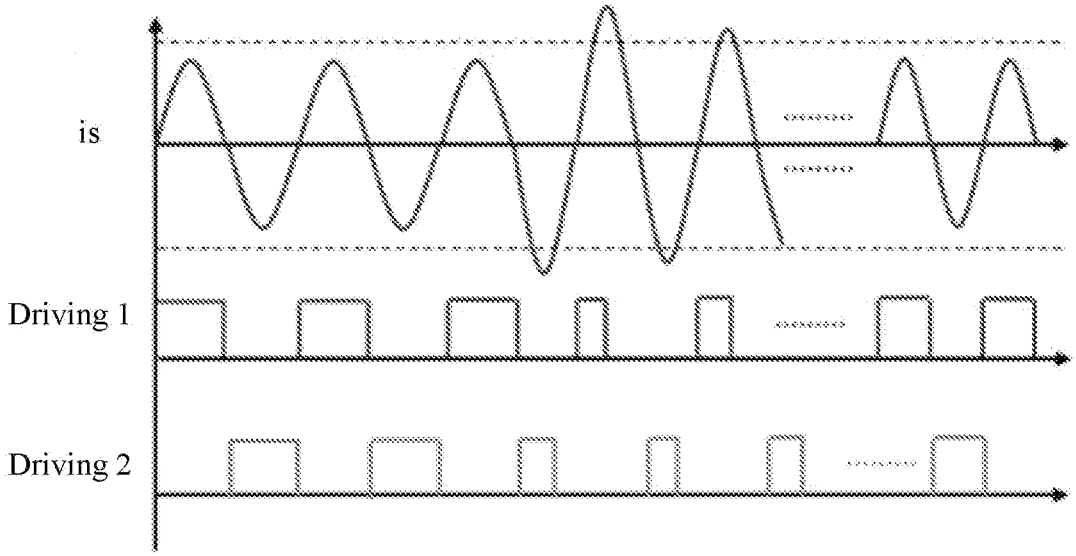
FIG. 8 is an illustrative waveform showing that the LED module is driven in a duty cycle adjustment manner according to a second embodiment of the disclosure.

FIG. 8 is an illustrative waveform showing that the output of the LED driving unit is driven in a duty cycle adjustment manner. In FIG. 8, the symbol is indicates a current instantaneous value sampled by the sampling circuit, the symbols Driving 1 and Driving 2 are driving signals supplied to the upper switching tube S1 and the lower switching tube S2 of the half-bridge circuit, respectively. When the detected current peak exceeds the preset reference value, the duty cycle of the corresponding driving signal is reduced so as to control the output current of the driving unit 111 to be reduced.

Third Embodiment

The above first and second embodiments illustrates that the output of the LED driving unit is adjusted by controlling the operating frequency or the duty cycle of the driving signal of the switching elements in the driving unit in an analog circuit manner. According to the third embodiment, the operating frequency or the duty cycle of the driving signal of the switching elements in the driving unit is controlled in a digital circuit manner, so as to adjust the output of the LED driving unit.

Figure 10:
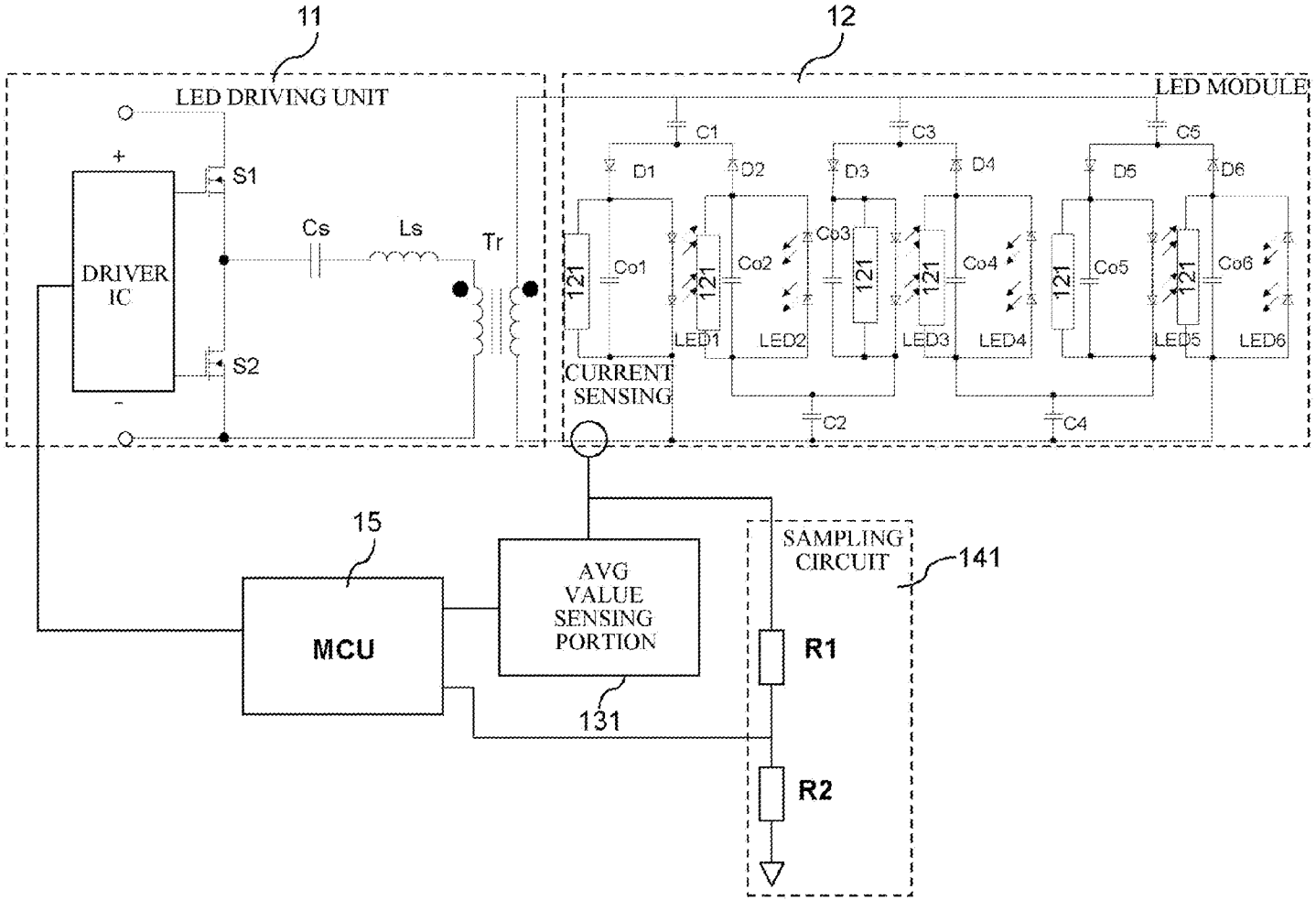
FIG. 10 is an illustrative detailed circuit diagram showing that the LED module is driven in a digital circuit manner according to the third embodiment of the disclosure.

As shown in FIG. 10, a driving apparatus according to the third embodiment includes a LED driving unit 11 and a LED module 12. The LED driving unit 11 is connected to the LED module 12 to drive the LED module 12. Configurations of the LED driving unit 11 and the LED module 12 herein are the same as those shown in FIG. 5, therefore the detailed description will be omitted With reference to FIG. 10, a current sensing portion (i.e., AVG value sensing portion) 131 is used to sense a current average value of the LED module 12. The current sensing portion 131 transmits the sensed current average value to a micro controller unit (MCU) 15. Similarly, a sampling circuit 141 samples a current instantaneous value of the LED driving unit 11 or the LED module 12, then transmits the sampled current instantaneous value to the MCU 15. The MCU 15 outputs an adjusting signal to the driving unit 11. The driving unit 11 controls the output of the LED driving unit 11 by controlling the operating frequency or the duty cycle of the driving signal of the switching elements in the driving unit based on the adjusting signal, so as to drive the LED module 12.

Although the disclosure is described in detail by the illustrative embodiments as above, the scope of the present disclosure is not limited to the above embodiments. All the modifications, equivalent substitution, and improvements which are made within sprits and principles of the present disclosure shall fall within the protection scope of the present disclosure.

What is claimed is:

1. A driving apparatus for driving a semiconductor light-emitting device assembly, comprising:

a driving unit configured to drive the semiconductor light-emitting device assembly;

a constant-current control unit configured to sample a current average value of the semiconductor light-emitting device assembly and control the driving unit according to the current average value, and a cycle by cycle control unit comprising:

a sampling circuit configured to sample a current instantaneous value of the driving unit or the semiconductor light-emitting device assembly; and an adjusting circuit configured to adjust an output of the driving unit when the current instantaneous value sampled by the sampling circuit is not less than a preset reference value, wherein when the current instantaneous value sampled by the sampling circuit is not less than a preset reference value, the driving unit is controlled by the constant-current control unit and the cycle by cycle control unit; and when the current instantaneous value sampled by the sampling circuit is less than the preset reference value, the driving unit is controlled by the constant-current control unit.

2. The driving apparatus according to claim 1, wherein the semiconductor light-emitting device assembly comprises more than one strings of semiconductor light-emitting devices connected in parallel.

3. The driving apparatus according to claim 2, wherein each string of the semiconductor light-emitting device comprises a filter capacitor, a protection circuit and a LED string, and the filter capacitor and the protection circuit are respectively connected in parallel to two ends of the LED string.

4. The driving apparatus according to claim 1, wherein a sampling point from which the sampling circuit samples the current instantaneous value is the same as a sampling point from which the constant-current control unit samples the current average value.

5. The driving apparatus according to claim 1, wherein a sampling point from which the sampling circuit samples the current instantaneous value is different from a sampling point from which the constant-current control unit samples the current average value.

6. The driving apparatus according to claim 1, wherein the driving unit comprises a first switch, a second switch, a resonant circuit and a transformer;

the first switch is connected with the second switch in series;

one end of the resonant circuit is connected to a connection point between the first switch and the second switch, and the other end of the resonant circuit is connected to one end of a primary side of the transformer;

the other end of the primary side of the transformer is connected to one end of the second switch which is not connected to the first switch.

7. The driving apparatus according to claim 1, wherein the sampling circuit comprises a first resistor and a second resistor connected in series, and one end of the first resistor is connected to a sampling point for sampling currents, the other end of the first resistor is connected to one end of the second resistor, and the other end of the second resistor is grounded.

8. The driving apparatus according to claim 7, wherein the adjusting circuit comprises a third resistor and a transistor;

an emitter of the transistor is grounded, a base of the transistor is connected to a connection point between the first resistor and the second resistor, a collector of the transistor is connected to one end of the third resistor, and the other end of the third resistor is connected to the driving unit.

9. The driving apparatus according to claim 7, wherein the adjusting circuit comprises a digital signal processing unit of which an input terminal is connected to a connection point between the first resistor and the second resistor and an output terminal is connected to the driving unit.

10. The driving apparatus according to claim 1, wherein the adjusting circuit is configured to adjust the output of the driving unit when the current instantaneous value sampled by the sampling circuit is not less than the preset reference value, so as to limit a current peak of the semiconductor light-emitting device assembly.

11. The driving apparatus according to claim 10, wherein the adjusting circuit is configured to limit the current peak of the semiconductor light-emitting device assembly by adjusting an operating frequency of the driving unit.

12. The driving apparatus according to claim 10, wherein the adjusting circuit is configured to limit the current peak of the semiconductor light-emitting device assembly by adjusting a duty cycle of the driving unit.

13. The driving apparatus according to claim 1, wherein the driving unit is a forward circuit, a flyback circuit, a half-bridge switching circuit or a full bridge switching circuit.

14. A method for driving a semiconductor light-emitting device assembly by using a driving apparatus, the driving apparatus comprising a driving unit configured to drive the semiconductor light-emitting device assembly; a constant-current control unit configured to sample a current average value of the semiconductor light-emitting device assembly and control the driving unit according to the current average value; and a cycle by cycle control unit comprising: a sampling circuit configured to sample a current instantaneous value of the driving unit or the semiconductor light-emitting device assembly; and an adjusting circuit configured to adjust an output of the driving unit when the current instantaneous value sampled by the sampling circuit is not less than a preset reference value, wherein the method comprises:

sampling, by the sampling circuit, a current instantaneous value of the driving unit or the semiconductor light-emitting device assembly;

comparing the current instantaneous value with the preset reference value;

adjusting, by the adjusting circuit, the output of the driving unit when the current instantaneous value is not less than the preset reference value; and driving the semiconductor light-emitting device assembly according to the output of the driving unit, wherein when the current instantaneous value sampled by the sampling circuit is not less than the preset reference value, the driving unit is controlled by the constant-current control unit and the cycle by cycle control unit; and when the current instantaneous value sampled by the sampling circuit is less than the preset reference value, the driving unit is controlled by the constant-current control unit.

* * * * *